United States Patent [19]

Shinozaki et al.

[11] Patent Number: 4,463,698

[45] Date of Patent: Aug. 7, 1984

[54] NEEDLE POSITION DETECTOR

[75] Inventors: Nozomu Shinozaki; Takashi Dohi, both of Hirakata; Shigeo Neki, Osaka, all of Japan

[73] Assignee: Matsushita Electric Industrial Co., Ltd., Osaka, Japan

[21] Appl. No.: 331,329

[22] Filed: Dec. 16, 1981

[30] Foreign Application Priority Data

Dec. 19, 1980 [JP] Japan ..... 55-180664

[51] Int. Cl.[3] ..... D05B 69/24

[52] U.S. Cl. ..... 112/275; 318/467

[58] Field of Search ..... 112/275, 277, 158 E, 112/67, 87; 318/652, 467, 275; 250/233, 230

[56] References Cited

U.S. PATENT DOCUMENTS

| | | | |
|---|---|---|---|
| 3,149,593 | 9/1964 | Johnston | 112/275 |
| 3,683,294 | 8/1972 | Gaa | 112/275 X |
| 3,990,374 | 11/1976 | Heidt . | |
| 4,013,933 | 3/1977 | Dohi et al. | 112/275 X |
| 4,269,132 | 5/1981 | Hsu | 112/275 |

FOREIGN PATENT DOCUMENTS 2155570 5/1973 France .

*Primary Examiner*—Peter P. Nerbun

*Attorney, Agent, or Firm*—Lowe, King, Price & Becker

[57] ABSTRACT

A needle position detector for a sewing machine includes a pair of disk-like members axially mounted on a rotary shaft coupled to the armshaft of the sewing machine. Each of the disk-like members is provided with an optically nonreflective portion occupying a greater area of its circumference and an optically reflective portion occupying a smaller area of the circumference. The disk-like members are adjusted so that the angular positions of the respective reflective portions correspond to the upper and lower needle positions. A light emitting element is associated with each of the disk-like members to emit light in a radial direction thereto. A light sensitive element is also associated with each disk-like member to receive light reflected from the reflective portion of the associated disk-like member to generate a needle position signal.

11 Claims, 3 Drawing Figures

NEEDLE POSITION DETECTOR

BACKGROUND OF THE INVENTION

The present invention relates generally to industrial sewing machines, and in particular to a needle position detector.

The needle position detector plays an important role of an industrial sewing machine due to the fact that the needle position information is used to control the solenoid-operated clutch and brake arrangement which is essential to a variety of industrial sewing functions including variable speed control and stoppage at desired needle positions. A high degree of precision and reliability is thus required of the needle position detector to meet the requirements of the industrial application. In order to monitor the instantaneous position of the needle, the detector is connected to the armshaft of the sewing machine with which the needle is driven and mounted on the sewing machine head. Being located in a position adjacent to the operator, the detector is required to be compact in design to allow space for sewing operations.

Conventional needle position detectors can be classified into a number of types including an electromagnetic system, oscillator type and an electrooptical system. In the electromagnetic system a permanent magnet is attached to a rotary part of the sewing machine so that its opposite poles correspond respectively to the upper and lower needle positions and a Hall generator is mounted stationarily with respect to the magnet. In another electromagnetic system, a ferromagnetic member is attached to the rotary part and the permanent magnet and Hall generator are mounted stationarily with respect to the rotating ferromagnetic member to generate a signal as the latter traverses the magnetic flux. However, shortcomings inherent in such electromagnetic systems are difficulty in determining the critical value of magnetic flux since a lower critical value will render the detector less immune to external magnetic flux and a higher critical value will require the use of a permanent magnet containing a costly rare earth element. Arranging the permanent magnet so that its opposite poles rotate at 180 degrees apart, while advantageous for keeping the size of the detector to a minimum, is disadvantageous due to the fact that for detecting upper and lower needle positions two of such magnets are required which must be spaced a distance sufficient to allow the Hall generator to sharply distinguish between adjacent poles. In another prior art electromagnetic detector, the magnet and Hall generator are mounted on a stationary support between which a slitted iron rotary disk is arranged to rotate to act as an interceptor. This type of system requires that the magnet and Hall generator be spaced a substantial distance apart for satisfactory operation and that the magnet be composed of a costly rare earth element to generate a strong magnetic field. Thus, the goal of compactness and economy has not yet been accomplished with conventional needle position detectors of the magnetic type.

Needle position detectors of the oscillator type, on the other hand, comprise a flux generating coil and a sensing coil which are mounted in an oppositely facing relation, and a slitted rotary iron disk which is arranged to rotate through the space between the two coils to alter the frequency of oscillation. Needle position detectors of the optoelectrical type currently include a set of a light emitting and sensitive elements which are facing to each other and between which is provided a rotary interrupter. However, in either of these prior art systems it is difficult to achieve compactness.

The problem of compactness is compounded by the fact that industrial sewing machines are operated in a wide range of speeds according to the depression of a foot pedal and this operating speed must be controlled with a high precision in a closed loop by sensing the actual speed of the sewing machine. Being coupled to the armshaft, the speed sensor reduces the space allowed for the needle position detector.

SUMMARY OF THE INVENTION

The present invention eliminates the aforesaid prior art problem by arranging a pair of disk-like members axially on a rotary shaft which is coupled to the armshaft for unitary rotation therewith, each of the disk-like members having an optically nonreflective portion occupying a greater circumferential area and an optically reflective portion occupying a smaller circumferential area. The optically reflective portions are positioned so that they are respectively associated with the upper and lower needle positions. A pair of light emitting elements is mounted stationarily so that the elements are associated with the disk-like members to direct light rays respectively to the reflecting portions of the disk-like members. A pair of light sensitive elements is located adjacent to the light emitting elements to receive light rays reflected respectively from the reflecting portions of the disk-like members to generate signals indicative of the upper and lower needle positions.

According to a feature of the present invention, the needle position detector allows ease with which the detector is precisely and quickly adjusted. The ease of adjustment feature is accomplished by the optically nonreflective portions of the disk-like members which extend a substantial area over the associated light sensitive elements. This serves to keep external light rays from interfering with the light sensitive elements. The detector further comprises a spring for urging the disk-like members in directions away from each other, a holding member axially movably mounted on the rotary shaft adjacent to one of the disk-like members and a screw threadably engaged with one end of the shaft for engaging the holding member with the adjacent disk-like member, whereby the disk-like members are resiliently held together when the screw is loosened for angular position adjustment.

Preferably, each of the disk-like members and holding member is axially movable but not rotatable with respect to the shaft when the screw is loosened for adjustment. This arrangement serves to keep one disk-like member from freely rotating while the other member is being adjusted.

BRIEF DESCRIPTION OF THE DRAWINGS

The present invention will be described in further detail with reference to the accompanying drawings, in which.

DETAILED DESCRIPTION

Figure 1:
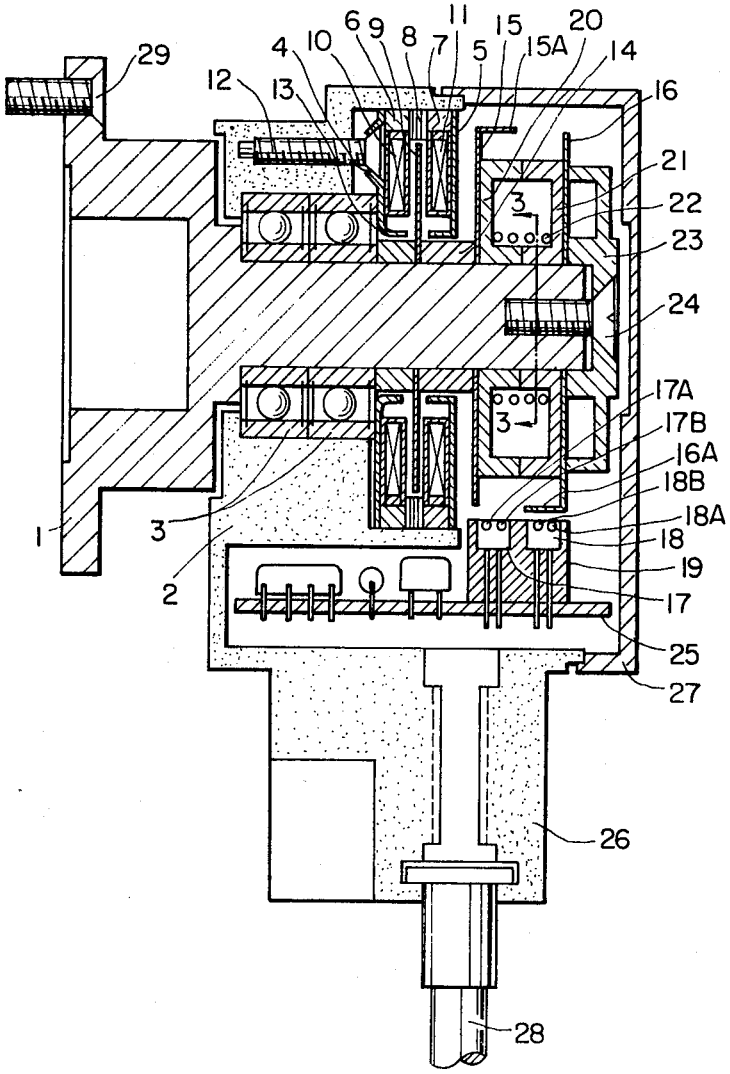
FIG. 1 is a cross-sectional view of a preferred embodiment of the needle position detector of the invention shown mounted in a common housing with a speed detector.

Referring now to FIG. 1, there is shown a preferred embodiment of the needle position detector of the invention which, for the purpose of illustration, incorporates a sewing speed detector in a common housing.

Before proceeding to a description of the needle position detector, it is appropriate to describe the speed detector with which the needle position detector of the invention is connected. The sewing speed detector comprises a rotor shaft 1 rigidly fixed to a sewing machine pulley, not shown, by screws 29 and then to the armshaft of the sewing machine. The rotor shaft 1 extends axially through a bearing 3 into a resin moulded housing 2 fixed to the sewing machine head (not shown). A pair of ring-shaped yokes 4 and 5, each composed of iron or any magnetic material, is rigidly secured to the housing 2 by screws 12 so that yoke 4 bears against an end wall of the bearing 3 to hold it in position. In the yokes 4 and 5 are provided ring-shaped permanent magnets 6 and 7, respectively. The permanent magnets 6 and 7 are magnetized so that the north pole of the former is on its right side and the north pole of the latter is on its left side. Between the permanent magnets 6 and 7 is a ring-shaped stator core 8 having a plurality of teeth on its inner periphery. Ring-shaped stator coils 10 and 11 are fixed to the yokes 4 and 5 respectively within the inner walls of the permanent magnets 6 and 7. Between the ring coils 10 and 11 is a toothed rotor wheel 9 which is fixed to the rotor shaft 1 by yokes or spacers 13 and 14.

The operation of the speed detector is as follows. The magnetic fluxes generated by the permanent magnets 6 and 7 pass through a common path formed by stator core 8 and rotor wheel 9 with the flux produced by magnet 6 passing through spacer 13 and yoke 4 crossing the ring coil 10 and the flux produced by magnet 7 passing through spacer 14 and yoke 5 to cross the ring coil 11. Since the magnetic flux passes through the variable spacing formed between the teeth of stator core 8 and rotor wheel 9, the reluctance value of the magnetic circuit varies at periodic intervals so that a voltage is induced in the coils 10 and 11 at a frequency related to the sewing speed. Since the stator core 8 and rotor wheel 9 forms the common magnetic circuit, the variations in the reluctance value occur simultaneously in the two magnetic circuits. Therefore, the voltage induced in the coil 10 is reverse in polarity to the voltage induced in the coil 11. The coils 10 and 11 are connected in series so that the voltages so generated are constructively added and supplied to the amplifier and thence to a waveshaping circuit to generate a train of rectangular pulses at a frequency inversely proportional to the speed of the sewing machine.

Description of the needle position detector will follow. The needle position detector includes a pair of first and second disks 15 and 16 adjustably mounted on the rotor shaft 1 and having at their circumference light reflecting members 15A and 16A which extend in axially opposite directions to each other. The light reflecting members 15A, 16A are composed of a material which stays reflective for extended periods such as stainless steel or iron plate electroplated with chromium. A pair of optoelectrical devices 17 and 18 is stationarily disposed in a resin block 19 on a printed circuit board 25 with respect to the light reflecting members 15A and 16A. Each optoelectrical device includes a light emitting element and a light receiving element which are designated by characters "A" and "B", respectively, attached to the numerals 17 and 18. The optoelectrical devices 17, 18 are preferably of the type which employs infrared light instead of visible light and a filter which allows the light receiving elements to respond exclusively to infrared light. The rotary disks 15 and 16 are spaced apart by a pair of moulded resin spacers 20 and 21 in the shape of a ring. Each spacer is formed with an annular groove in which a compression spring 22 is provided. The spacers 20 and 21 are composed of a black resinous material to present an optically nonreflective surface to incident light. This nonreflective surface extends over the light receiving elements to keep them from being interfered with unwanted light rays. As will be described later, the disks 15 and 16 are adjusted so that their reflective members are angularly positioned to correspond to the upper and lower needle positions, respectively.

It is seen that the disk 15 with its optically reflective member 15A and spacer 20 constitute a first disk-like member having an optically nonreflective portion occupying a greater circumferential area as provided by spacer 20 and an optically reflective portion occupying a smaller circumferential area as provided by the reflective member 15A. The disk 16 with its reflective member 16A and spacer 21 constitute a second disk-like member having a second optically nonreflective portion occupying a greater circumferential area as provided by spacer 21 and an optically reflective portion occupying a smaller circumferential area as provided by the reflective member 16A. Due to the axial arrangement of the light reflecting disk-like members and the radial arrangement of the electrooptical sensing devices with respect to the rotor shaft 1, the needle position detector of the invention can fit into a relatively small area. As will be understood, the manual adjustment of the detector is made with ease in spite of the reduced size.

The light reflective members 15A and 16A each have radial extent greater than the radial extent of each spacer so that the reflective members are closer to the electrooptical devices 17 and 18. This eliminates the use of lenses for forming the emitted light into a narrow beam, which would only add extra cost.

A moulded resin holding member 23 is adjustably fixed to the distal end of the rotor shaft 1 by means of an adjustment screw 24 to axially clamp the disks 15 and 16.

On the printed circuit board 25 are mounted an amplifier and other auxiliary circuits which are coupled to transmit needle position signals to external control circuitry by a cable 28 which is clamped in position by a resin mould 26 which forms part of the housing 2. The whole unit is enclosed by a cover 27.

Figure 2:
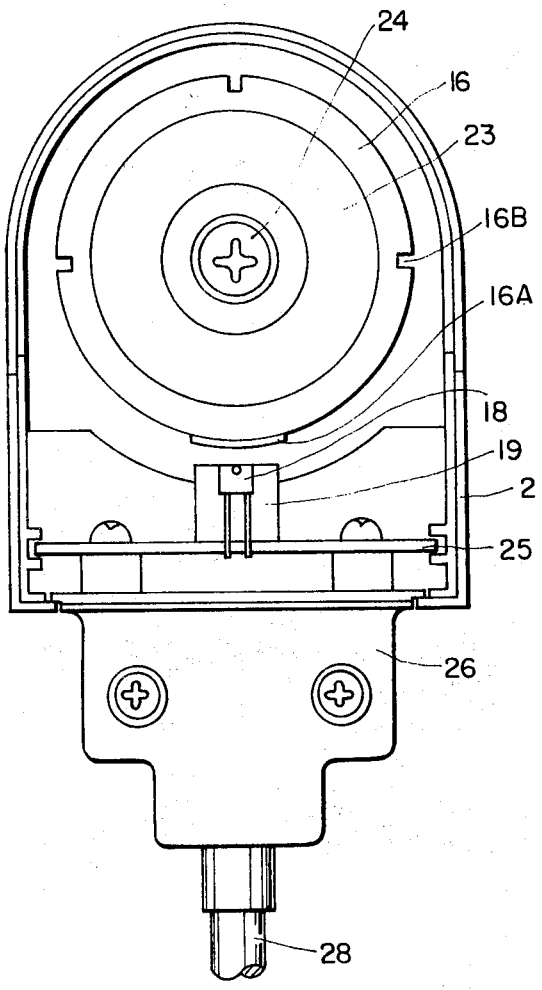
FIG. 2 is an end view of the needle position detector with a cover being removed.

FIG. 2 is an illustration of an end view seen from the right side of the needle position detector with the cover 27 being removed to make the inside visible. As seen in FIG. 2, the disk 16 is formed with a plurality of slits 16B at the circumference thereof to permit a screwdriver to extend therethrough in a manner as will be described later. The light reflecting member 16A has an arcuate extent of approximately 30 degrees on the circumference of the rotary disk 16.

The light emitting elements 17A and 18A are constantly energized to emit light rays which are reflected from reflecting members 15A and 16A as they come to their downward positions to the light receiving elements 17B and 18B. Needle position signals are thus generated when the sewing needle comes to upper and lower positions. When the light reflecting members 15A and 16A are displaced from their downward positions, the emitted light is absorbed by the nonreflective surface of the spacer 20 or 21.

Since the nonreflective surface provided by the spacers 20, 21 extends a substantial area over the light sensitive elements, external light is successfully kept from interfering with such elements. Furthermore, since the external light, either from natural or artifical source, has a lesser amount of components in the infrared light region, the use of infrared electrooptical devices 17, 18 renders them less susceptible to such external light.

Description will now be concerned with manual adjustment of the disks 15 and 16 which is carried out with the cover 27 being removed.

Figure 3:
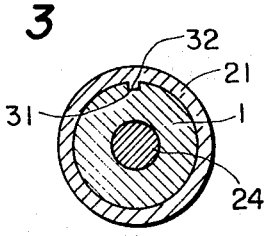
FIG. 3 is a cross-sectional view taken along the line 3—3 of FIG. 1.

A needle-down position adjustment is accomplished by positioning the light reflecting member 15A to its downward position with the needle being positioned downward, while a needle-up position adjustment is achieved by positioning the light reflecting member 16A in its downward position with the needle being positioned upward. It is seen that needle-up and needle-down position adjustments can be effected independently of each other. However, after the manual adjustment has been made with respect to one of the light reflecting members, it is necessary that this adjusted member be held rigidly in position while the other member is subsequently adjusted. This is accomplished by the provision of an axially extending groove 31, as. illustrated in FIG. 3, on the rotor shaft 1 and corresponding lugs 32 on the inner wall of the spacers 20, 21 and holding plate 23 so that the latter is axially movable but not rotatable with respect to the rotor shaft 1.

The purpose of the spring 22 is to resiliently hold the light reflecting disks 15 and 16 together to keep their relative angular positions when the screw 24 is loosened for adjustment. With this arrangement the angular position of the disk 16 can be adjusted with a screwdriver by engaging it with one of its recesses 16B, while the oppositely biased spacers 20 and 21 keep the other disk 15 from becoming loosened.

After both disks have been adjusted to right positions, the screw 24 is tightened and in doing so the holding plate 23 is only allowed to move axially but not rotatable with the screw 24 thus preventing the disk 16 from being displaced from the right angular position.

What is claimed is:

1. A needle position detector for a sewing machine having an armshaft and a needle adaped to reciprocate by rotation of said armshaft, comprising:

a shaft rotatable with said armshaft;

a pair of disk-like members axially disposed on said shaft for unitary rotation therewith, each of said members having an optically nonreflective portion occupying a greater circumferential area and optically reflective portions occupying a smaller circumferential area, said optically reflective portions being respectively associated with the upper and lower needle positions;

a pair of light emitting elements for directing light rays respectively to said reflecting portions;

a pair of light sensitive elements for receiving light rays reflected respectively from said reflecting portions to generate signals indicative of said needle position; and slit means located on the periphery of one of the disk-like members that permits manual adjustment of the angular positions of said disk-like members so that the optically reflective portions thereof correspond respectively with the upper and lower needle positions.

2. A needle position detector as claimed in claim 1, further comprising a spacer located between said disk-like members, wherein said spacer is formed of an optically nonreflective material located to face said light sensitive elements.

3. A needle position detector as claimed in claim 1, further comprising a spring mounted between said light reflecting members to urge said members in directions away from each other against said adjusting means.

4. A needle position detector as claimed in claim 2 or 3, wherein each of said light emitting elements emits infrared light, and each of said light receiving elements is sensitive to infrared light.

5. A needle position detector for a sewing machine having an armshaft and a needle adapted to reciprocate by rotation of said armshaft, comprising:

a shaft rotatable with said armshaft;

a pair of disk-like members axially disposed on said shaft for unitary rotation therewith, each of said members having an optically nonreflective portion occupying a greater circumferential area and optically reflective portions occupying a smaller circumferential area, said optically reflective portions being respectively associated with the upper and lower needle positions;

a pair of light emitting elements for directing light rays respectively to said reflecting portions;

a pair of light sensitive elements for receiving light rays reflected respectively from said reflecting portions to generate signals indicative of said needle positions; and means located at one end of said rotary shaft for permitting manual adjustment of the angular positions of said disk-like members so that the optically reflective portions thereof correspond respectively with the upper and lower needle positions, said manual adjustment means including means clamping the disks together and acting upon a resilient means axially biasing the disk-like members to prevent loosening of one of said members during manual calibration when the clamping means is loosened for adjustment.

6. a needle position detector as claimed in claim 5, wherein each light emitting element emits infrared light and each light receiving element is sensitive to infrared light.

7. A needle position detector as claimed in claim 5, further comprising means for urging said disk-like members in directions away from each other, a holding member axially movably mounted on said shaft adjacent one of said disk-like members and a screw threadedly received in one end of said shaft for engaging said holding member with said adjacent disk-like member under pressure, said disk-like members being resiliently held together by the urging means when said screw is loosened.

8. A needle position detector as claimed in claim 7, wherein each of said disk-like members and holding member is axially movable but non-rotatable with respect to said shaft when said screw is loosened.

9. A needle position detector as claimed in claim 7 or 8, wherein said disk-like members include a pair of disks being axially movable on said shaft when said screw is loosened, each of said disks having an axially and circumferentially extending portion of optically reflective material and a pair of spacers of optically nonreflective material which are axially movable on said shaft between said disks when said screw is loosened, each of said spacers being formed with an annular groove in which said urging means is disposed.

10. A needle position detector as claimed in claim 9, wherein each of said disks is formed with a recess on the circumference thereof.

11. The needle position detector of claim 9, wherein said urging means is a coil spring.

* * * * *